United States Patent [19]

Herr

[11] Patent Number: 4,775,187

[45] Date of Patent: Oct. 4, 1988

[54] FOLDING BOAT CHAIR

[76] Inventor: Richard W. Herr, 8145 S.W. 90th Terrace, Miami, Fla. 33156

[21] Appl. No.: 81,532

[22] Filed: Jul. 15, 1987

Related U.S. Application Data

[63] Continuation of Ser. No. 710,613, Mar. 11, 1985, abandoned.

[51] Int. Cl.[4] ..... A47C 7/02; A47C 7/42

[52] U.S. Cl. ..... 297/378; 16/257; 16/374; 297/349; 297/443; 297/DIG. 3

[58] Field of Search ..... 297/349, 354, 378, 379, 297/440, 443, DIG. 2; 16/257, 259, 363, 374, 376; 248/415

[56] References Cited

U.S. PATENT DOCUMENTS

| | | | |
|---|---|---|---|
| 3,245,717 | 4/1966 | Levy | 297/335 X |
| 3,388,421 | 6/1968 | Koziol | 16/374 X |
| 3,432,882 | 3/1969 | Farouche | 16/257 |
| 4,026,600 | 5/1977 | Kubaguchi | 297/DIG. 2 X |
| 4,133,579 | 1/1979 | Springfield | 297/DIG. 2 X |
| 4,143,436 | 3/1979 | Jones | 297/349 X |
| 4,477,199 | 10/1984 | Manzoni | 16/374 X |

FOREIGN PATENT DOCUMENTS

| | | | |
|---|---|---|---|
| 2202107 | 8/1973 | Fed. Rep. of Germany | 297/349 |
| 2202259 | 8/1973 | Fed. Rep. of Germany | 297/378 |
| 86830 | 7/1981 | Japan | 297/DIG. 2 |
| 1551827 | 9/1979 | United Kingdom | 16/257 |

*Primary Examiner*—Kenneth J. Dorner
*Assistant Examiner*—Peter R. Brown
*Attorney, Agent, or Firm*—Fleit, Jacobson, Cohn & Price

[57] ABSTRACT

A folding boat chair formed by a molded plastic seat member and a molded plastic back member. An integral boss on the underside of the seat member presents a socket which fits on the top end of an upright post mounted in the boat. The seat can turn on the post and can be locked in place by a clamp mechanism. Pins which are integral with the sides of the back member fit in passages in sides of the seat member to pivotally connect the members without the need for separate hinge components.

9 Claims, 2 Drawing Sheets

Fig. 1.
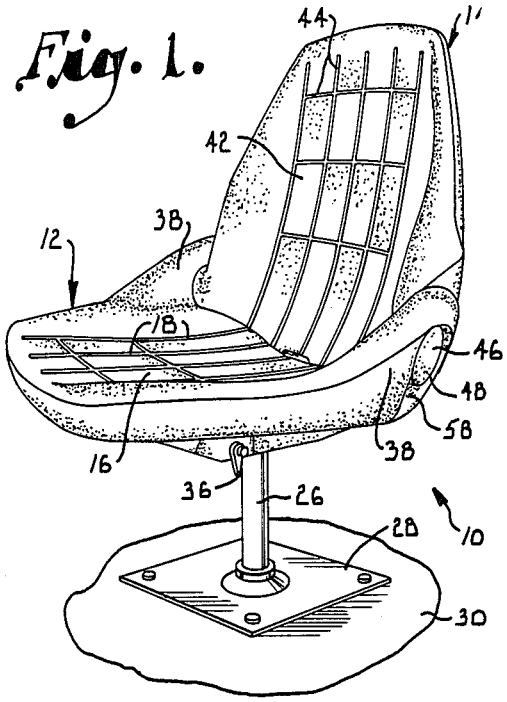
Fig. 2.
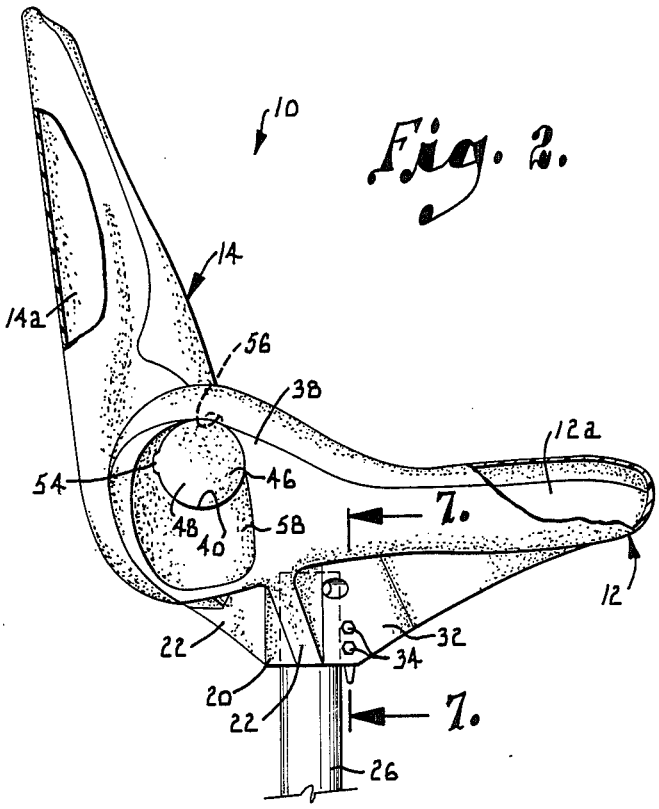
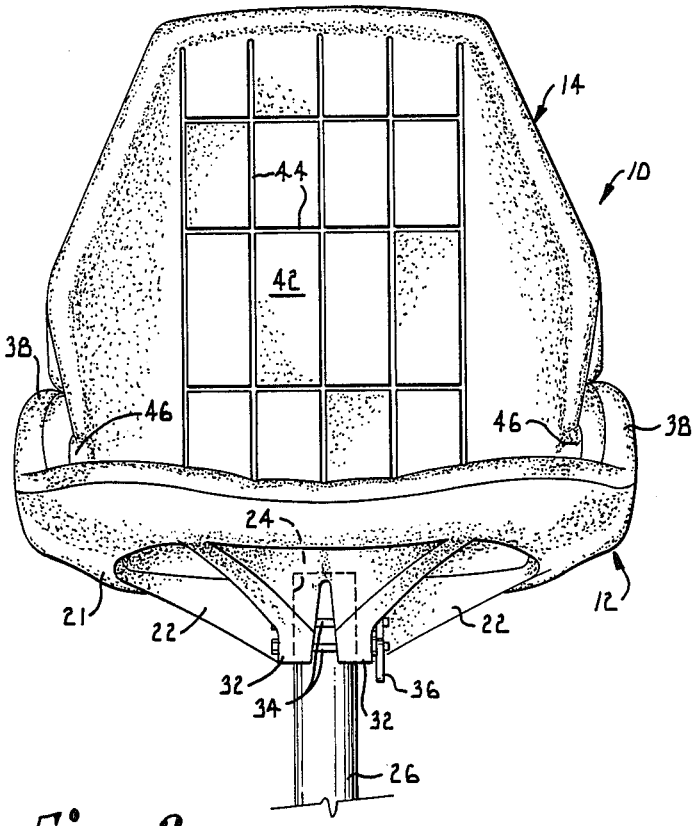
Fig. 3.
Fig. 7.
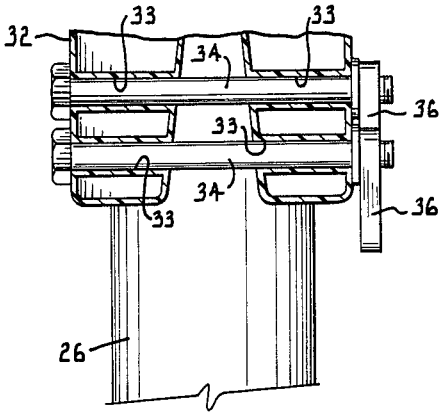

FOLDING BOAT CHAIR

This application is a continuation of application Ser. No. 710,613, filed on Mar. 11, 1985, now abandoned.

BACKGROUND AND SUMMARY OF THE INVENTION

This invention relates generally to chairs such as those used on fishing boats and in other applications and deals more particularly with a folding chair formed entirely by two molded plastic pieces.

Bass boats and other small fishing boats normally have as standard equipment a swivel type chair which permits the fisherman to face various directions. Typically, the boat chair includes a seat and a back which are formed from plywood or a similar material covered with vinyl or fabric covering. The back and seat are fastened together by multiple piece hinges having some components fastened to the seat and some to the back. The hinge connection permits the back to be folded up during use and down for storage such as when the boat is being towed over the road on a trailer. The seat piece typically has a metal casting fastened to its underside. A socket formed in the casting fits on the post to mount the chair so that it can turn about the post axis. A clamp or similar mechanism allows the chair to be fixed in place after it has been turned to the desired position.

As can easily be appreciated, significant labor is required to install the fabric or vinyl covering, and the overall cost of the boat chair increases accordingly. Additional costs, both in labor and materials, arise from the need to bolt or otherwise fasten the metal hinge components to both the back and seat pieces of the chair. The need for a separate metal casting to provide the chair with swiveling capability adds to the cost, as does the labor and fasteners that are necessary to mount the casting on the bottom of the seat.

In view of these problems, it is evident that a need exists for a folding and/or rotatable chair which is simpler and less expensive than the chairs that have been available in the past. It is the principal goal of the present invention to meet that need.

In accordance with the invention, rotary casting techniques are used to form both the seat and back pieces of a two piece chair of the type on fishing boats and in other applications. The seat member has a socket integrally molded on its underside and reinforced by a series of rigid ribs. The socket can be applied to the post in the fishing boat in order to mount the chair for turning movement about the post axis. A conventional clamp can be provided to permit the chair to be locked in any desired rotative position.

The seat has integral sides which are provided with cylindrical passages. The molded back piece of the chair has projecting pins on its opposite sides which can be fitted into the passages in a snap fit during assembly of the chair. The fit of the pins in the passages forms a horizontal axis about which the back can be pivoted between its functional upright position and a horizontal storage position. A detent holds the back down in the storage position so that it does not create wind resistance or other problems when the boat is being towed on a trailer.

The chair includes only the seat and back members and does not require separately attached hinges or a separately attached swivel. Consequently, its overall construction is simpler and more economical than conventional folding boat chairs. At the same time, the use of molded plastic and rotary casting techniques results in a tough and durable construction while maintaining a relatively light weight.

DETAILED DESCRIPTION OF THE INVENTION

In the accompany drawings which form a part of the specification and are to be read in conjunction therewith and in which like reference numerals are used to indicate like parts in the various views:

FIG. 1 is a perspective view of a folding chair which is constructed according to a preferred embodiment of the present invention, showing the chair installed in a boat on top of a vertical post;

FIG. 2 is a side elevational view of the boat chair shown in FIG. 1;

FIG. 3 is a front elevational view of the boat chair;

FIG. 7 is a fragmentary sectional view on an enlarged scale taken generally along line 7—7 of FIG. 2 in the direction of the arrows.

Figure 4:
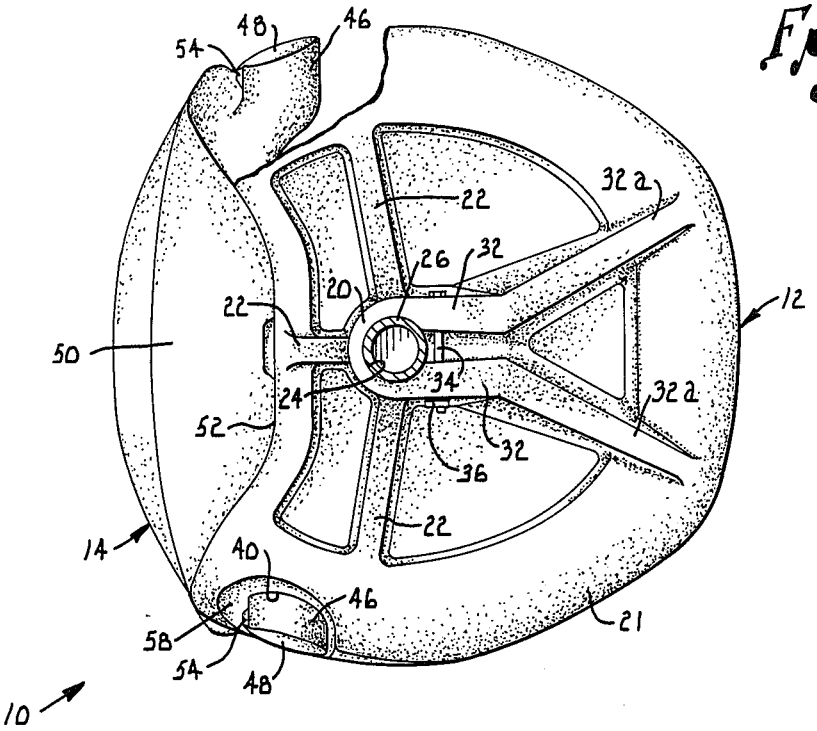
FIG. 4 is a bottom plan view of the boat chair, with a portion broken away for purposes of illustration.

Referring now to the drawings in more detail, numeral 10 generally designates a folding and rotatable chair constructed in accordance with a preferred embodiment of the present invention. The chair 10 has two components, a seat member 12 and a back member 14. Both the seat member and the back member are molded from a tough, rigid plastic. Preferably, a rotary casting operation is used to mold the seat member and back member. The rotary casting technique involves placing the plastic material in a mold which is then rotated so that the centrifugal force causes the plastic to move outwardly onto the mold surfaces, leaving a hollow interior within each molded piece. Thus, the seat 12 and back 14 have hollow interiors **12*a* and 14*a*, as can best be seen in FIG. 2**. This results in a sufficiently strong chair construction while making the chair light in weight and conserving material.

The seat number 12 of the chair has an upper seat surface 16 which is generally horizontal and flat although contoured somewhat for comfort. Crisscrossing grooves 18 are molded into the seat surface 16.

The bottom surface of the seat member 12 is provided with an integral boss 20 having a generally cylindrical configuration. Boss 20 is located within and projects below a rim 21 which extends around the periphery of the bottom surface of the seat member. The boss 20 projects well below the bottom of the seat and is integral with the remainder of the seat and with a plurality of ribs 22 which serve to strengthen and reinforce the boss 20. The reinforcing ribs 22 extend generally radially from the cylindrical boss 20 and angle from the lower end of the boss to connection with the lower surface of the seat member 12. The boss 20 and ribs 22 are hollow.

A cylindrical socket 24 is formed in the boss 20. The socket 24 is open at the bottom and has a diameter to closely receive the upper end portion of an upright cylindrical post 26. The post 26 is secured to a pedestal or plate 28 (see FIG. 1) which is mounted on the boat floor 30 or other surface on which the chair is installed.

A pair of parallel ribs 32 extend generally forwardly from boss 20 on opposite sides of the socket 24. The forward ends 32a of the ribs 32 diverge somewhat and merge with the bottom side of the seat member.

The fit of socket 24 on the upper end of post 26 mounts the seat member 12 on top of the post with the seat surface 16 facing upwardly. The seat member can turn about the axis of the post. As best shown in FIG. 7, the ribs 32 are each provided with a pair of openings 33 through which bolts 34 or a similar clamp device can be installed. The bolts 34 receive nuts having handles 36 which serve to tighten and loosen the nuts. When the handles are tightened, the ribs 32 are squeezed together to squeeze socket 24 on the post 26, thereby locking the seat member 12 in place against rotation on the post. The handle 36 can be loosened to loosen the socket so that the seat member can be turned to a different rotational position before one or both bolts are again tightened to lock the seat in place.

The seat member 12 has a pair of opposite sides 38 which project upwardly slightly above the seat surface 16. Each side 38 is provided with a cylindrical passage 40 which extends completely through the side. The two passages 40 are oriented horizontally and are aligned with one another.

The back member 14 has a contoured front surface 42 which forms a back rest when the back member is in its upright functional position. Crisscrossing grooves 44 similar to grooves 18 are formed in the back rest surface. A pair of cylindrical pins 46 are molded integrally with the opposite sides of the back member 14 near its lower end. The pins 46 are axially aligned and are substantially equal in diameter to the passages 40 formed in the seat sides 38. As best shown in FIG. 4, the free end surface 48 of each pin 46 is a beveled surface which angles outwardly somewhat from back to front. The width of the back member 14 in the area adjacent the pins 46 is substantially equal to the distance between the inside surfaces of the sides 38 of the seat member.

After the seat member 12 and back member 14 have been molded, they are pivotally connected by inserting the pins 46 into the passages 40. This is accomplished by holding the back member 14 in an upright position and forcing it to the rear such that the pins 46 press against the inside surfaces of the sides 38. As the back member 14 is moved rearwardly, the sides 38 are deflected outwardly somewhat by the pins 46. The sides 38 are sufficiently flexible to deflect enough to permit the pins 46 to enter passages 40 in a snap fit. It is pointed out that the beveled surfaces 48 on the ends of pins 46 facilitate the gradual approach of the pins toward the passages 40 and facilitate entry of the pins into the passages during assembly of the chair.

When the pins 46 have snapped into passages 40, the back member 14 is permanently connected to the seat member 12 for pivotal movement about the horizontal pivot axis provided by the aligned pins 46. When the chair 10 has been installed on post 26, the back member 14 can pivot between the upright position shown in FIG. 2 and the folded storage position shown in FIG. 5. The lower edge of the back member 14 has a projecting tongue 50 (see FIGS. 4 and 5) which engages the contoured back edge 52 of the seat member 12 when the back member has reached its upright position. The tongue 50 thereby prevents the back member from moving beyond the upright position in which the front surface 42 provides a generally vertical back rest surface.

Figure 5:
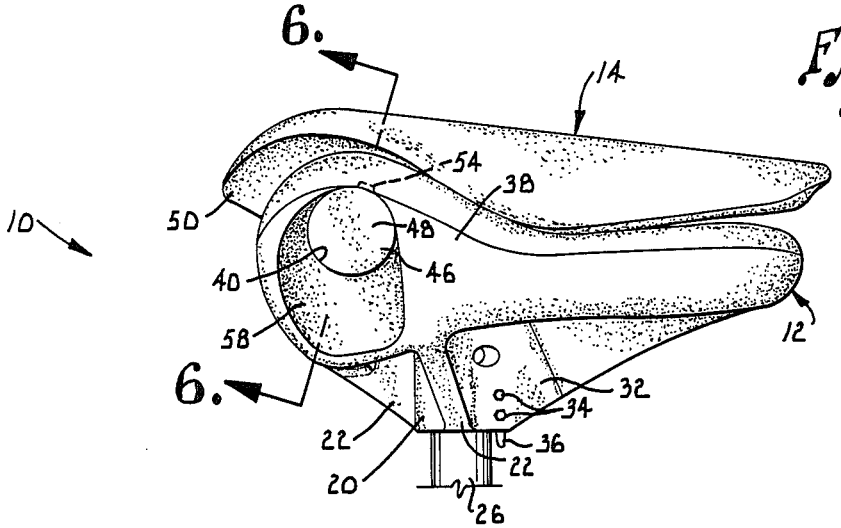
FIG. 5 is a side elevational view similar to FIG. 2, but with the back piece folded down to its storage position.
Figure 6:
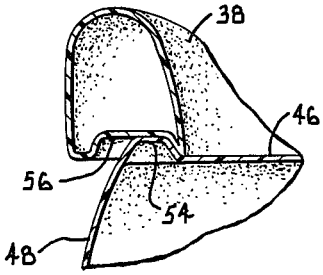
FIG. 6 is a fragmentary sectional view on an enlarged scale taken generally along line 6—6 of FIG. 5 in the direction of the arrows.

The pins 46 can turn in passages 40 so that the back member 14 can be pivoted downwardly to the folded storage position of FIG. 5. A button 54 is formed on the outer surface of each pin 46 to form a detent arrangement in cooperation with groove 56 which is formed in the top portion of each passage 40. The buttons 54 are positioned so that they enter the grooves 56 when the back member 14 has been pivoted downwardly to the storage position. Then, the fit of the buttons 54 in the grooves 56 provides a releaseable detent which holds the back member 14 down in the storage position. In this position, the back member has a substantially horizontal orientation and immediately overlies the top surface 16 of the seat member to present a low profile when the boat is being towed over the road in a trailer. The detent arrangement holds the back member down against forces tending to inadvertently raise it. When sufficient force is applied tending to raise the back member 14, the buttons 54 are displaced from the grooves 56, and the back member can be easily raised to its functional position.

The outside surfaces of the opposite sides 38 are recessed at 58. The buttons 54 are normally located in the recesses 58 and do not engage the surfaces which surround passages 40 until the back member closely approaches the storage position. In this manner, the buttons 54 are prevented from constantly engaging the surfaces which surround passages 40, and undue wear is thus avoided.

The need for separate hinge components is eliminated by the molding of the pins 46 on the back member 14 and the ability of the pins to be inserted in a snap fit into the passages 40. The integral molding of the boss 20 on the underside of the seat member likewise eliminates the need to provide and attach a separate casting or other part to form the swivel mechanism for the chair. Only the two pieces, the seat member 12 and back member 14, are required, and the simplicity and economy of the chair is enhanced accordingly. At the same time, the tough and durable plastic material which forms the seat and back members provides the chair with sufficient strength to withstand the forces that are normally applied to it. The reinforcing ribs 22 and 32 are important in that they provide the necessary strength and reinforcement to the projecting boss 20 which forms the socket 24.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A folding chair comprising:

a hollow seat member having a top surface providing a seat surface and a bottom surface having means thereon for mounting the seat member on a support post in a boat;

a pair of opposite sides located on a rear portion of said seat member and being formed integrally therewith, said sides extending above said top surface and having openings therein substantially horizontally aligned with one another, each side having an an inside surface;

a hollow back member having a front surface providing a back rest and a pair of pins formed integrally with said back member at a lower portion of said hollow back member and projecting outwardly from opposite sides thereof, said pins being in axial alignment with one another and being insertable in said openings for axial turning movement therein to connect said hollow back member with said hollow seat member for pivotal movement relative thereto between a generally upright position wherein the hollow back member extends upwardly from the hollow seat member and a folded storage position wherein the hollow back member has a generally horizontal orientation and overlies the hollow seat member; and a beveled end surface on each pin on a free end thereof, said end surfaces angling outwardly from a trailing edge to a leading edge in the upright position of the hollow back member, said trailing edge being spaced a substantial distance from said leading edge, said inside surfaces of said sides of said hollow seat member deflecting away from one another as said pins are slid toward said openings from front to back during application of said hollow back member to said hollow seat member during assembly of the chair, said pins being received in said openings by snapping action upon registration therewith as said sides deflect back toward one another to retain said pins in said openings.

2. The invention of claim 1, including detent means for releaseably retaining said hollow back member in the storage position thereof.

3. The invention of claim 1, including:

a groove in each side of said hollow seat member, said grooves having preselected locations adjacent the respective openings; and a button on each pin, said buttons being located to enter the respective grooves when said hollow back member is pivoted to the storage position thereof, whereby the fit of said buttons in said grooves provides a releasable detent for retaining said hollow back member in its storage position.

4. A chair for installation on a generally vertical post in a boat, said chair comprising:

a hollow seat member having top and bottom surfaces and a boss on said bottom surface formed integrally with said hollow seat member, said boss having a generally cylindrical socket therein sized to be closedly applied to the post to mount said hollow seat member on the post for rotation about the post axis;

a pair of spaced apart ribs integral with said hollow seat member and said boss and extending from said boss on opposite sides of said socket along said bottom surface of the hollow seat member;

releasable means for squeezing said ribs together to lock said seat member in place on the post against rotation thereof;

a hollow back member pivotally connected with said seat member and extending generally upwardly therefrom to form a back support, a pair of generally cylindrical pins molded integrally with said hollow back member and projecting from opposite sides thereof in axial alignment with one another, said pins fitting closely in passages defined by said hollow seat member to establish a generally horizontal pivot axis about which said back member is pivotal between a generally upright position and a folded storage position wherein the back member immediately overlies the seat member; and a beveled end surface on each pin on a free end thereof, said end surfaces angling outwardly from a trailing edge to a leading edge in the upright position of said hollow back member, said trailing edge being spaced a substantial distance from said leading edge.

5. A two-piece folding chair for installation on a generally vertical post in a boat, said chair comprising:

a molded plastic seat member being hollow and having top and bottom surfaces and opposite sides extending above the top surface, said seat member presenting a substantially cylindrical passage in each side with said passages being located substantially in horizontal alignment with one another and extending completely through said sides between inside and outside surfaces of the sides;

a boss molded integrally with said seat member on the bottom surface thereof, said boss presenting a generally cylindrical socket therein sized for application to the post and adapted to closely receive same to mount said seat member on the post for rotation about the post axis;

a molded plastic back member being hollow having opposite sides and a front surface providing a back rest;

a pair of generally cylindrical pins molded integrally with said back member and projecting from the opposite sides thereof in axial alignment with one another, said pins fitting closely insaid passages to establish a generally horizontal pivot axis about which said back member is pivotal between a generally upright position and a folded storage position wherein the back member immediately overlies the seat member;

a beveled end surface on each pin on a free end thereof, said end surfaces angling outwardly from a trailing edge to a leading edge in the upright position of said hollow back member, said trailing edge being spaced a substantial distance from said leading edge; and a recess on the outside surface of each of said sides, said pins extending completely through said passages and into said recesses to securely connect the back and seat members together with said recesses receiving the pins to prevent the pins from projecting beyond the outside surfaces of said sides.

6. The invention of claim 5, including a beveled surface on a free end of each pin to facilitate entry of said pins into said openings.

7. The invention of claim 4, including end portions of said ribs which diverge as they extend away from said boss.

8. A folding chair comprising:

a hollow seat member having a top surface providing a seat surface and a bottom surface having means thereon for mounting the seat member on a support post in a boat, said hollow seat member further including a front portion and a rear portion, said rear portion being recessed to form a U-shaped configuration;

a pair of opposite sides on said hollow seat member formed integrally therewith at said rear portion and forming a U-shaped configuration with said top surface, said sides extending above said top surface and having openings therein substantially horizontally aligned with one another, said openings extending through said hollow seat member from said top surface and terminating in recesses defined by said bottom surfaces, and each side having an inside surface;

a hollow back member having a front surface providing a back rest and a pair of pins located at a lower portion of said hollow back member, formed integrally with said hollow back member and projecting outwardly from opposite sides thereof, said pins being in axial alignment with one another and being insertable in said openings for axial turning movement in said openings and said recesses to connect said hollow back member with said hollow seat member for pivotal movement relative thereto between a generally upright position wherein the back member extends upwardly from the hollow seat member and a folded storage position wherein the back member has a generally horizontal orientation and overlies the seat member, said hollow back member being supported by said hollow seat member when in said upright position along said rear portion of said hollow seat member and said lower portion of said hollow back member, said hollow back member further including a projection extending from said lower portion of said hollow back member, said projection extending into said U-shaped rear portion of said hollow seat member for supporting said hollow back member by said hollow seat member; and a beveled end surface on each pin on a free end thereof, said end surfaces being angled outwardly from a trailing edge to a leading edge in said upright position of said hollow back member to slide against the inside surfaces of said sides of said hollow seat member in a manner to deflect said sides away from one another as the pins are slid toward the openings from front to back during application of the back member to the seat member during assembly of the chair, said trailing edge being spaced a substantial distance from said leading edge, said pins being received in said openings and recesses by snapping action upon registration therewith as the sides deflect back toward one another to retain the pins in the openings.

9. A folding chair comprising:

a hollow seat member having a top surface providing a seat surface and a bottom surface having means thereon for mounting the seat member on a support post in a boat;

a pair of opposite sides located on a rear portion of said seat member and being formed integrally therewith, said sides extending above said top surface and having openings therein substantially horizontally aligned with one another, each side having an an inside surface;

a hollow back member having a front surface providing a back rest and a pair of pins formed integrally with said back member at a lower portion of said hollow back member and projecting outwardly from opposite sides thereof, said pins being in axial alignment with one another and being insertable in said openings for axial turning movement therein to connect said hollow back member with said hollow seat member for pivotal movement relative thereto between a generally upright position wherein the hollow back member extends upwardly from the hollow seat member and a folded storage position wherein the hollow back member has a generally horizontal orientation and overlies the hollow seat member; and a beveled end surface on each pin on a free end thereof, said end surfaces angling outwardly from back to front in the upright position of the hollow back member to slide against the inside surfaces of said sides of said hollow seat member in a manner to deflect said sides away from one another as said pins are slid toward said openings from front to back during application of said hollow back member to said hollow seat member during assembly of the chair, said pins being received in said openings by snapping action upon registration therewith as said sides deflect back toward one another to retain said pins in said openings;

a groove in each side of said hollow seat member, said grooves having preselected locations adjacent the respective openings; and a button on each pin, said buttons being located to enter the respective grooves when said hollow back member is pivoted to the storage position thereof, whereby the fit of said buttons in said grooves provides a releasable detent for retaining said hollow back member in its storage position.

* * * * *